US005388306A

United States Patent [19]

Bedol

[11] Patent Number: 5,388,306

[45] Date of Patent: Feb. 14, 1995

[54] ERASER FOR A RING BINDER

[76] Inventor: Mark A. Bedol, 6980 Fabriano Pl., Rancho Cucamonga, Calif. 91701

[21] Appl. No.: 111,977

[22] Filed: Aug. 25, 1993

[51] Int. Cl.[6] ..... B43L 19/00

[52] U.S. Cl. ..... 15/424; 15/426; 402/4

[58] Field of Search ..... 15/424, 425, 426, 105.51; D19/53; 402/4

[56] References Cited

U.S. PATENT DOCUMENTS

| | | | |
|---|---|---|---|
| D. 8,486 | 7/1875 | Roberts | 15/424 X |
| D. 146,481 | 3/1947 | Manheimer | D19/53 |
| D. 166,252 | 3/1952 | Fusco | D19/53 |
| 578,190 | 3/1897 | Barr | 15/426 |
| 1,067,012 | 7/1913 | Faber | 15/425 |
| 1,550,770 | 8/1925 | Akira | 15/424 |

FOREIGN PATENT DOCUMENTS

| | | | |
|---|---|---|---|
| 8797 | 5/1898 | United Kingdom | 15/425 |

*Primary Examiner*—Edward L. Roberts

[57] ABSTRACT

An eraser for a ring binder comprising an eraser element having at least one hole extending therethrough. The hole is sized so as to provide access to a ring of a ring binder. The eraser preferably has a triangle-like shape comprising a base, a first side, and a second side. The base is preferably curved so as to accommodate a notebook organizer of the type having an organizer base with a substantially flat bottom surface and with a plurality of holes being adapted for engagement with the rings of a ring notebook.

13 Claims, 1 Drawing Sheet

ERASER FOR A RING BINDER

BACKGROUND OF THE INVENTION

1. Field of the Invention

The present invention relates to erasers and more particularly to an eraser which may be securely stowed in a ring binder.

2. Description of the Related Art

Users of ring binders often have a desire to organize and store items associated with the use of the ring binder. To this end, the present applicant has patented a notebook organizer (U.S. Pat. No. 5,058,736, entitled NOTEBOOK ORGANIZER INCLUDING SLIDABLE ELEMENT, issued Oct. 22, 1991) which generally comprises a base having a substantially flat bottom surface and a border with a plurality of holes therethrough, the holes being adapted for engagement with the rings of a ring binder. The base includes a plurality of partitions dividing the base into a plurality of compartments. There is at least one lid associated with at least one of the compartments, including means for connecting the lid to the base. The lid has a substantially flat upper surface.

Although the '736 device is an efficient, space-saving means for storing several functional elements, the present invention further enhances the utility of ring binders by eliminating the need for an eraser to be stored within the compartments of the notebook organizer or to be held separately from the binder.

SUMMARY OF THE INVENTION

The present invention is an eraser for a ring binder. In its broadest aspects it comprises an eraser element having at least one hole extending therethrough, the hole being so sized so as to provide access to a ring of a ring binder. The eraser element preferably has two substantially planar surfaces so as to be easily accommodated in a ring binder and a triangle-like shape with a base being curved so as to be easily positionable adjacent to a notebook organizer as described in the above-mentioned U.S. Pat. No. 5,058,736.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figure 1:
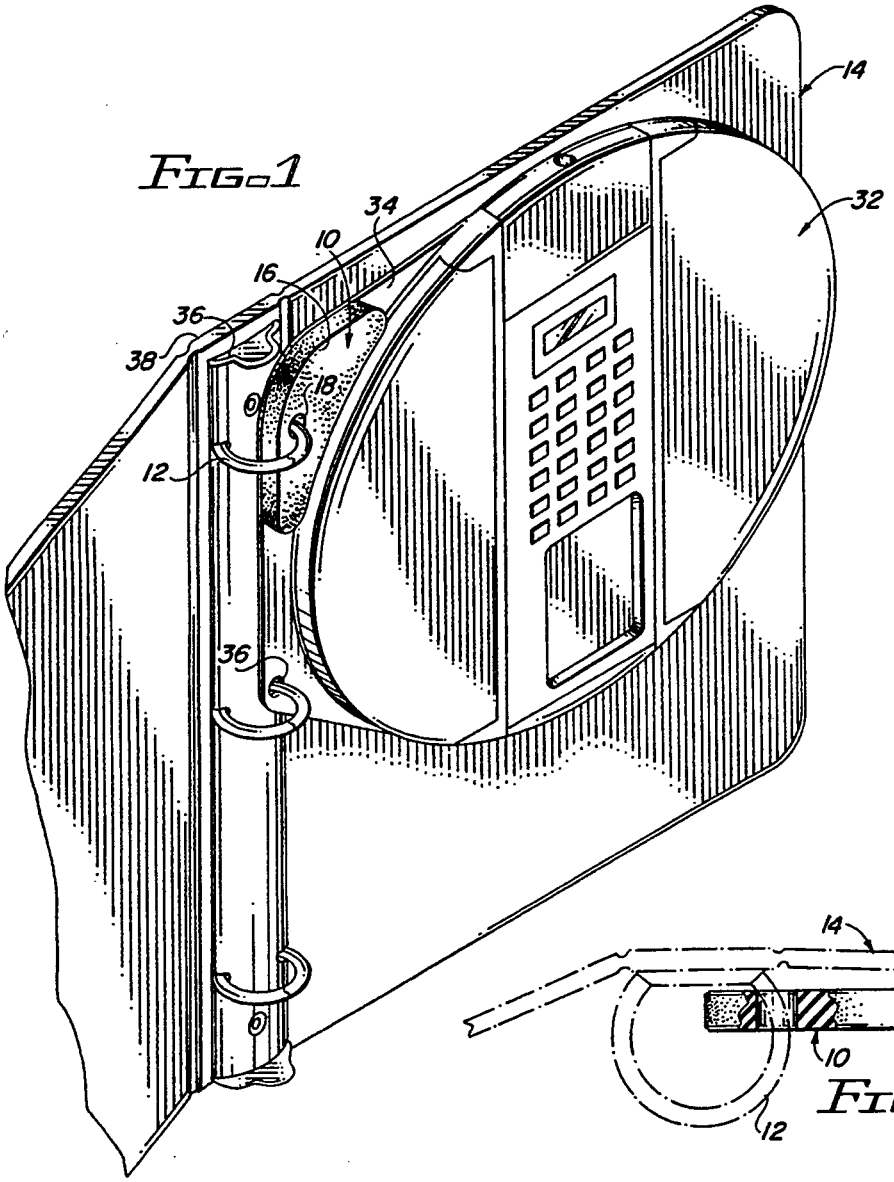
FIG. 1 is a perspective illustration of a ring binder supporting a notebook organizer and also supporting the eraser of the present invention.
Figure 4:
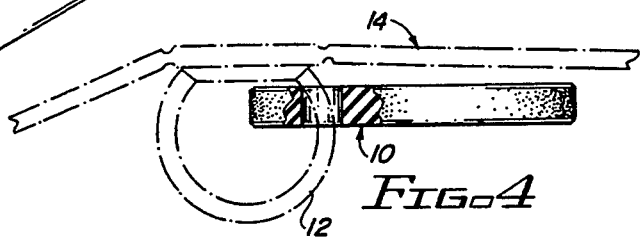
FIG. 4 is a top view of the eraser being supported by a ring binder.

Referring to the drawings and the characters of reference marked thereon, FIG. 1 illustrates the eraser of the present invention, designated generally as 10, being supported by a ring 12 of a ring binder designated generally as 14. The eraser comprises an eraser element 16 having at least one hole 18 sized so as to provide access to the ring 12. The eraser element 16 is preferably formed of a solid material. It may be formed of any conventional eraser material such as plastic, plastic rubber, thermoplastic rubber or other rubber material. It preferably has two substantially planar surfaces so as to be easily accommodated in the ring binder 14.

Figure 2:
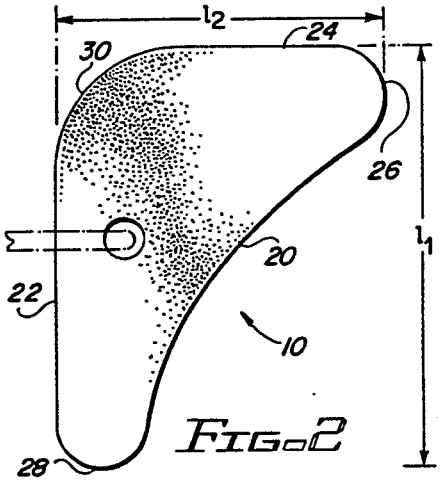
FIG. 2 is a top planar view of the eraser of the present invention engaged with the ring of a ring binder.
Figure 3:
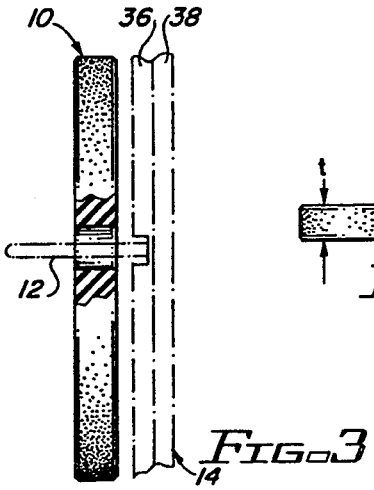
FIG. 3 is a side view of the eraser being supported by a ring binder.

Referring now to FIG. 2, a top planar view of the eraser 10 is shown so as to emphasize its unique shape. Each planar surface has a triangle-like shape comprising a base 20, a first side 22, and a second side 24. The base 20 is shaped concave. Furthermore, the regions 26, 28, 30, where the base meets the sides and where the sides meet each other, are rounded. Thus, the term 'triangle-like' as that term is used herein, refers to a geometry resembling a triangle, however modified so that the base is shaped concave and the edges around it are curved, as described above.

Figure 5:
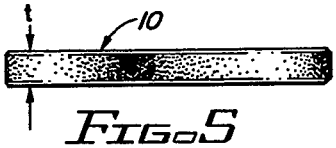
FIG. 5 is a bottom view of the eraser.

Length $1_1$ is preferably in the range of about 6–9 centimeters, optimally about 7.5 centimeters. The length $1_2$ is preferably in a range of about 4–8 centimeters, preferably about 6 centimeters. The thickness, t, (see FIG. 5) may be in a range of about 3 millimeters to about 9 millimeters, preferably about 7 millimeters.

As mentioned above, the present invention is particularly adapted for use with the notebook organizer disclosed and claimed in U.S. Pat. No. 5,058,736 entitled "NOTEBOOK ORGANIZER INCLUDING A SLIDABLE ELEMENT," issued to the present applicant. Use of the present apparatus 10 in conjunction with such a notebook organizer is shown in FIG. 1, the notebook organizer being designated generally as 32. U.S. Pat. No. 5,058,736 is hereby incorporated herein by reference. The notebook organizer 32 has a base 34 having a substantially flat bottom surface and two holes being adapted for engagement with the rings 12 of the ring binder 14.

The eraser 10 rests efficiently on the border of the notebook organizer base 34 which may, as shown in FIG. 1, fit between the eraser 10 and a metal spine 36, which in turn is connected to the book spine 38 of the notebook 14. The rim of the notebook organizer 32 is round and the concave eraser base 20 fits neatly around this rim.

Obviously, many modifications and variations of the present invention are possible in light of the above teachings. It is therefore to be understood that., within the scope of the appended claims, the invention may be practiced otherwise as than as specifically described. For example, although the base has been described above to be semi-circular in order to accommodate the round perimeter of the "NOTEBOOK ORGANIZER" described in the '736 patent it may be formed in other shapes which accommodate various other shapes of notebook organizers.

What is claimed and desired to be secured by Letters Patent of the United States is:

1. An eraser for a ring binder, comprising:

an eraser element having at least one hole extending therethrough, said hole being so sized so as to provide access to a ring of a ring binder, wherein said eraser element comprises two substantially planar surfaces so as to be easily accommodated in said ring binder, each planar surface comprising a base, a first side, and a second side.

2. The eraser of claim 1 wherein said eraser element is formed of solid material, said hole being formed in said solid material.

3. The eraser of claim 1 wherein said eraser element has a thickness in a range of between 3 mm and 9 mm.

4. The eraser of claim 1 wherein said eraser element has a thickness of approximately 7 mm.

5. The eraser of claim 1 wherein said at least one hole comprises a single hole.

6. The eraser of claim 1 wherein each planar surface has a triangle-like shape.

7. The eraser of claim 6 wherein each said base is shaped concave and wherein regions in which said base meets said sides and where said sides meet each other are rounded.

8. The eraser of claim 7 wherein said base is curved so as to accommodate a notebook organizer of the type having an organizer base having a substantially flat bottom surface and having a plurality of holes being adapted for engagement with the rings of a ring notebook, said organizer base including a plurality of partitions dividing the organizer base into a plurality of compartments, the outer perimeter of said compartments being curved.

9. The eraser of claim 8 wherein said base has a semicircular curve.

10. The eraser of claim 1 wherein said eraser element is formed of rubber.

11. The eraser of claim 1 wherein said eraser element is formed of plastic rubber.

12. A method for conveniently stowing an eraser, comprising:

a) providing an eraser element having at least one hole extending therethrough, said hole being so sized so as to provide access to a ring of a ring binder;

b) opening said ring binder to provide access to said ring for said eraser;

c) inserting said eraser through said ring into said ring binder so as to be conveniently stowed therein.

13. An eraser for a ring binder, comprising:

an eraser element having at least one hole extending therethrough, said hole being so sized so as to provide access to a ring of a ring binder, wherein said eraser element comprises two substantially planar surfaces so as to be easily accommodated in said ring binder, each planar surface comprising a base, a first side, and a second side, said base being shaped so as to accommodate the outer perimeter of a notebook organizer of the type having a plurality of partitions dividing the organizer base into a plurality of compartments.

* * * * *